United States Patent [19]

Rekewitz

[11] Patent Number: 4,641,982

[45] Date of Patent: Feb. 10, 1987

[54] HOUSING COVER FOR PRINTERS

[76] Inventor: Rudolf Rekewitz, Waldstrasse 2a, D8190 Wolfratshausen, Fed. Rep. of Germany

[21] Appl. No.: 701,665

[22] Filed: Feb. 15, 1985

Related U.S. Application Data

[63] Continuation of Ser. No. 472,754, Mar. 7, 1983, abandoned.

[30] Foreign Application Priority Data

Mar. 30, 1982 [DE] Fed. Rep. of Germany ..... 3211757

[51] Int. Cl.[4] ..... B41J 29/08

[52] U.S. Cl. ..... 400/690.1; 400/690.4

[58] Field of Search ..... 400/578, 607.2, 633.2, 400/646, 647, 647.1, 605, 689, 690, 690.1, 690.2, 690.3, 690.4, 693

[56] References Cited

U.S. PATENT DOCUMENTS

| | | | |
|---|---|---|---|
| 1,422,433 | 7/1922 | Fries | 400/690.2 |
| 1,647,674 | 11/1927 | Tyberg | 400/690 |
| 1,938,531 | 12/1933 | Ostrey | 400/633.2 |
| 3,333,671 | 8/1967 | Rohde | 400/646 X |
| 3,901,372 | 8/1975 | Denley | 400/693 X |

FOREIGN PATENT DOCUMENTS

| | | | |
|---|---|---|---|
| 33973 | 4/1981 | Japan | 400/647.1 |

OTHER PUBLICATIONS

IBM Technical Disclosure Bulletin, vol. 23, No. 9, Feb. 1981, pp. 3965–3966, "Single Sheet Insertion" by Garrison et al.

IBM Technical Disclosure Bulletin, vol. 24, No. 8, Jan. 1982, p. 4348, "Cover Section for Paper Opening of a Printer" by Mott et al.

*Primary Examiner*—Paul T. Sewell

*Assistant Examiner*—Charles A. Pearson

[57] ABSTRACT

A printer housing cover particularly adapted for use with printers capable of operating either with endless tractor fed perforated margin paper or single sheet paper. The housing cover has a portion thereof overlying the paper roller or platen defining a slot through the housing cover for paper egress. The portion overlying the platen is pivotable to provide a wide opening above the platen with the pivoted portion forming a paper support surface for insertion of single sheets.

13 Claims, 2 Drawing Figures

HOUSING COVER FOR PRINTERS

This is a continuation of application Ser. No. 472,754, filed Mar. 7, 1983, now abandoned.

BACKGROUND OF THE INVENTION

1. Field of the Invention

This invention relates to printer assemblies and more particularly to a housing cover for printer assemblies.

2. Prior Art

Automatic, and semi-automatic printers such as text terminal hard copy printers, data printers or the like, are frequently designed such that either single sheet or continuous paper can be utilized by the printer. When the device is being used as a data printer, continuous paper is predominately utilized. In such instances, the printer is generally completely covered by a cover member which extends over the platen except for a narrow paper exit slot. Such covers are used to reduce otherwise disturbing noise propagation.

However, when it is desired to utilize the text printer with individual sheets, either the cover has to be opened to expose the platen or the cover has to be initially provided with an additional feed slot for insertion of the single sheets. Such additional feed slots reduce the noise dampening effect of the cover when utilized in the continuous paper mode and, of course, the necessity to remove covers not provided with additional feed slots is both disruptive of efficient utilization of the printer and substantially eliminates the possibility of any noise dampening when using single sheets.

Furthermore, when utilizing single sheets, it is necessary to provide guide means on the printer to facilitate proper insertion of the paper sheet and in order to guarantee undisrupted paper transport. However, such guide means are generally not needed for continuous paper where a tractor mechanism assures proper paper feed, or where paper feed is aligned by means of guide members specifically provided for continuous sheet.

It would therefore be an advance in the art of printer mechanism design and construction to provide a housing cover for such printers which is optimumly operated with both continuous and single sheet paper and which is designed such that in addition to operation with continuous paper, a simple mechanism is provided for insertion of single sheets while maintaining a cover design providing optimum noise restraint.

SUMMARY OF THE INVENTION

This invention overcomes the disadvantages of the prior art and meets the above criteria. A housing cover for printer devices is provided which substantially encloses the printing area of the printer to form a noise barrier. The housing cover has a top with a hinged portion overlying the printer platen. With the hinged portion in its hinged down position, the front edge thereof is spaced from the remainder of the forward portion of the cover by an amount sufficient to provide an exit path for continuous paper passing around the platen. In its hinged up position, the hinged portion provides open access to the platen area and furthermore forms a paper seating surface against which single sheet paper may be guided for insertion into the platen area.

The insertion of single sheets is significantly facilitated in that the hinged cover portion can be easily lifted up from its platen overlying position and upon being hinged up forms a surface extending upwardly.

from the back area of the paper roller or platen and therefore serves as a paper seating surface for single sheets being fed into the rear of the platen. Optimum noise resistance is nevertheless guaranteed by the fact that the hinged cover portion can be closed when operating with continuous paper leaving only an exit slot open above the print area. Adjustable paper detents may be provided on the hinge portion of the cover along with or independently of a paper alignment scale to facilitate alignment of the single sheets to be inserted into the platen area.

The overall device can be economically manufactured by means such as plastic injection molding.

It is therefore a principal object of this invention to provide a printer noise suppressant cover having a portion thereof overlying the paper roller or platen, the portion being spaced from a forward portion of the printer cover by a slight amount providing a paper exit adjacent the front portion of the platen, the portion being hinged to the remaining parts of the cover and being moveable from a closed position to an open position allowing access to substantially the full depth of the platen area, the hinged portion providing a paper seat when in the open position.

It is another, and more specific, object of this invention to provide a noise suppressant cover for printers having paper drive platens adjacent a print area with the cover having a hinged portion overlying the platen extending axially thereof and being hinged for movement between a closed position overlying the platen and substantially closing the platen area except for an exit slot adjacent the forward part of the platen area and an open position projecting upwardly and backwardly from the platen area providing a large area opening to the platen area and further providing a guiding and support surface for insertion of single sheets into the rear portion of the platen area.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure and in which:

DESCRIPTION OF THE PREFERRED EMBODIMENT

Figure 1:
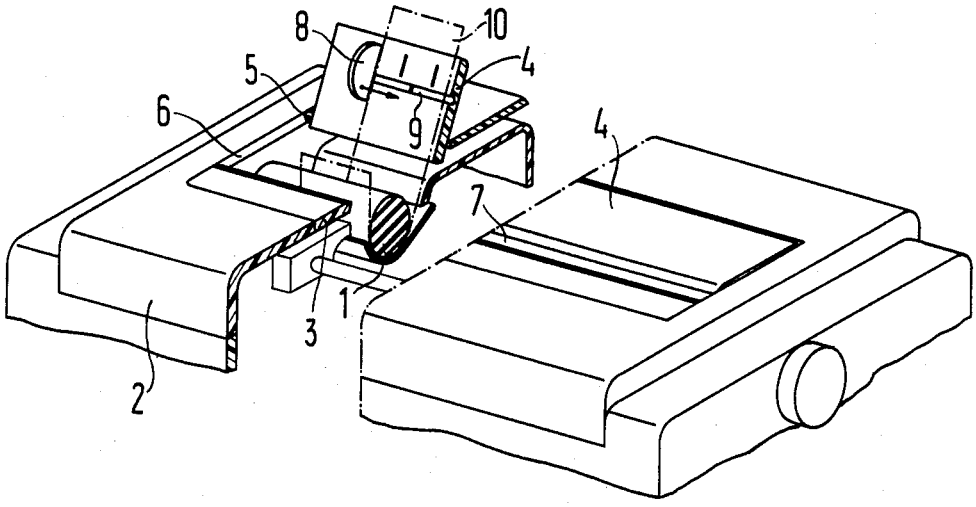
FIG. 1 is a schematic illustration of a cover according to this invention with the right half of the figure showing the cover in its closed position and the left half of the figure showing in perspective section the cover in its open position.

The figures illustrate an automatic or semiautomatic printer such as, for example, a mosaic or pin printer utilizing a moving print head which is moved lengthwise of a platen 1. The printer is of the type equipped for continuous paper feed, and to that end, portions of the platen, or portions affixed to the platen may be provided with tractor devices such as drive pins indexing with marginal perforations in the paper. Alternatively, the printer could be of the type that relies solely upon platen pressure for advancement of continuous paper. When utilizing continuous paper, the rear of the cover 2 may be open providing an entrance for continuous paper generally stored to the rear of the printer. The device, as illustrated, is also utilizable with single sheet paper. To this end, the upper portion of the printer housing is ergonomicly designed and includes a housing cover 2 formed of a noise resistant synthetic having a viewing window or transparent portion 3 which enables the printing location opposite the print head to be seen. Ideally, the housing 2 substantially encloses the entire print area where noise is primarily generated. The housing 2 has a hinged section or portion 4 which may, for example, be hinged to the remaining cover portion by pins 5 located in grooves 6 formed in the cover 2 at the marginal side edges of the platen area.

The portion 4 is pivotable about the pins 5 from a closed position shown on the right hand side of FIG. 1 to an open position illustrated at the left hand side of FIG. 1. When in the closed position, for operation with continuous paper, the front edge of the hinged portion 4 is spaced a slight distance from the transparent section 3 forming a exit slot 7 for egress of continuous paper passing around the platen 1 from the rear to the front thereof. In its hinged upwardly position, illustrated at the left hand side of FIG. 1, the hinged cover portion 4 may serve as a paper seating surface for single sheets. To this end, in its hinged up position, the bottom edge thereof will be positioned with respect to the platen to provide the proper infeed angle to the rear area of the platen. Laterally moveable paper guides 8 and or a paper alignment scale 9 may be positioned on the surface of the hinged cover for use in properly aligning and guiding single sheets being fed to the platen area. In this manner, introduction of single sheets 10 into the platen area in the proper position for being acted upon by the print head is facilitated.

Figure 2:
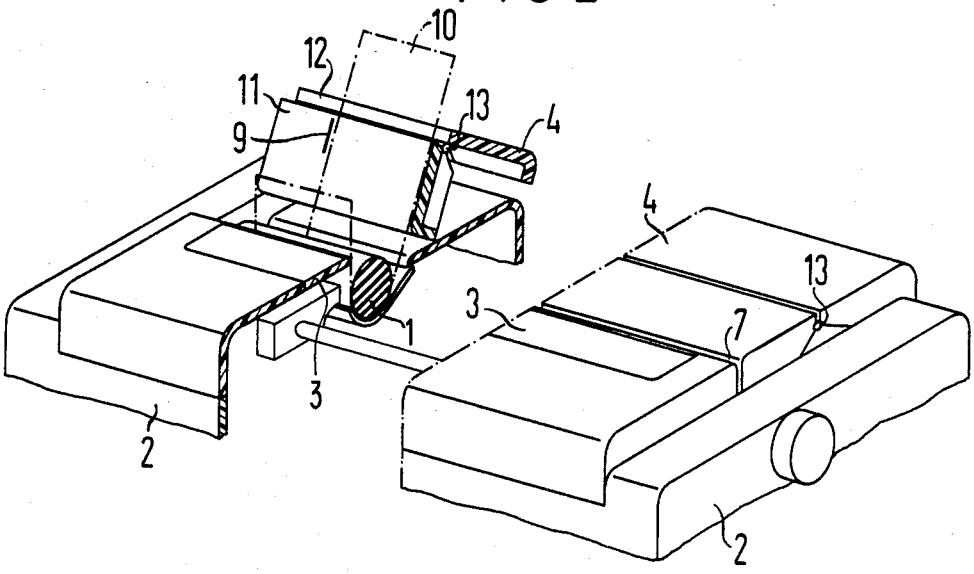
FIG. 2 is a view similar to FIG. 1 showing another embodiment of the hinged cover portion.

FIG. 2 illustrates a modification of the cover of FIG. 1. In this embodiment, rather than the hinged portion consisting only of a hinged strip which forms a portion of the cover top between otherwise fixed portions, the entire rear portion may be double hinged so that it is formed of two parts or individual cover portions 11 and 12, each of which are connected to the other along a longitudinal joint 13. Once again, one or both of the pieces may have pins equivalent to pins 5 riding in guides at the sides of the cover or may be otherwise connected to the main cover portion. In the embodiment illustrated in FIG. 2, the rear leg of the two portion cover can provide a support brace for the front portion. That is, the backmost portion of the cover, 12, can act as a brace for the foremost portion 11. The front portion can again be provided with guides or scales.

It is to be understood that in the embodiment illustrated in FIG. 1, due to the longitudinal movement nature of the cover because of the pin projections, that the pins could be either towards the rear of the cover portion allowing the cover to be hinged upwardly and backwardly or could be adjacent the front portion in which case projecting guides 8 would be formed on the top of the hinged portion and not otherwise depend into the platen area when closed. Utilizing such a forward hinge, the cover portion is opened by pivoting up the back portion and then sliding the entire hinged cover portion towards the rear. In order to positively fix the proper positioning of the hinged cover, the pins 5 could rest in a recess in the groove 6 when in the proper hinged up position and when in the proper hinged down position.

It will of course be appreciated that other modifications will be apparent to those skilled in the art.

Although various minor modifications may be suggested by those versed in the art, it should be understood that I wish to embody within the scope of the patent warranted hereon all such modifications as reasonably and properly come within the scope of my contribution to the art.

I claim as my invention:

1. A printer housing and cover for a printer having a platen area with a platen therein and a print head movable along the platen to imprint paper passing around the platen, said cover comprising a planar cover top surface overlying a top of said printer and having an opening above said platen area, a rearward opening between the printer housing and cover for entry of continuous paper, a paper exit slot in the cover above and towards the front of the platen area for exit of continuous paper and a cover top portion overlying the platen area, said cover top portion being connected to said cover by hinges, said cover and said hinges being disposed in a plane including said top surface, said hinges formed by lateral pins extending from said cover top portion and received in grooves in the sides of said openings so as to be forwardly and rearwardly translatable therein, said cover portion having a front edge defining a rear edge of the slot and being movable from a first position in said plane including said top surface substantially covering the platen area with the front edge of the cover top portion being spaced from portions of the cover to define the paper exit slot, the slot extending along the platen area and open to the top of the cover to a second position substantially uncovering the platen area for insertion of single sheets to the rear of the platen, the cover top portion in the second position having a portion projecting upwardly and rearwardly from the platen area and defining a paper guidance and support surface at the rear of the platen area for proper insertion of single sheet paper.

2. A printer housing and cover according to claim 1, wherein the cover top portion includes a paper guide.

3. A printer housing and cover according to claim 2, wherein said hinges are adjacent a forward edge of the cover top portion when the cover is in said first position.

4. A printer housing and cover according to claim 3, wherein a portion of the cover forward of the slot is transparent.

5. A printer housing and cover according to claim 4, wherein the cover top portion consists of two portions hinged together along a transverse dimension of the cover top with a forward portion defining the guidance surface when in the second position and a rearward portion defining a support for the forward portion.

6. A housing cover having a planar top surface for printers operated with continuous and with single sheet paper, said cover having a hinged portion connected to said top surface by pins received in grooves in said cover so as to be forwardly and rearwardly translatable therein and covering the printer platen and platen feed area, the hinged portion being movable from a hinged down position wherein said hinged portion, said pins, said grooves and said top surface are co-planar to a raised up position, the hinged portion having a front edge defining, in the hinged down position, the rear of a delivery slot extending along the length of the platen area, the slot open to the top of the cover forward of the platen for continuous paper exiting from the platen, the forward edge of the slot being defined by non-hinged portions of the cover, and the hinged cover portion in its raised up position substantially uncovering the platen area allowing access to the rear of the platen for insertion of single sheet paper from the top of the cover, the hinged cover, when in its raised up position, forming a paper seating surface for proper aligned guidance of single sheet paper being inserted into the platen feed area.

7. A housing cover according to claim 6, wherein the hinged portion includes two individual portions connected to one another by means of a joint and where, in the raised up position, one of the individual portions forms a paper seating surface and the other of the individual portions forms a support element for the one of the individual portions.

8. A housing cover according to claim 6, wherein the hinged portion forming the paper seating surface includes and adjustable paper guide.

9. A housing cover according to claim 6, wherein the hinged portion forming the paper seating surface includes a paper alignment scale.

10. A housing cover according to claim 7, wherein the hinged portion forming the paper seating surface carries an adjustable paper guide.

11. A housing cover according to claim 7, wherein the hinged portion forming the paper seating surface includes a paper alignment scale.

12. A housing cover for paper printers having a platen area comprising a cover member having a planar top surface adapted to substantially overlie the platen area having a stationary portion and a hinged portion connected thereto by pins adjacent a forward edge of said hinged portion received in grooves in said stationary portion so as to be forwardly and rearwardly translatable therein, the hinged portion extending along the length of the platen area and movable from a first position overlying the platen area and substantially closing the same except for an exit slot with said top surface, said pins, said grooves and said hinged portion disposed in the same plane to a second position substantially uncovering the platen area and projecting upwardly and rearwardly from the platen area and forming a paper guidance and support surface for single sheet paper being inserted into the rear of the platen area.

13. A housing cover according to claim 12, wherein the hinged portion includes first and second coplanar portions hinged together along the length of the platen area when in the first position with the first portion forming the paper guidance surface when in the second position and the second portion forming a brace for the first portion.

* * * * *